United States Patent [19]

Fabian et al.

[11] Patent Number: 4,703,896

[45] Date of Patent: Nov. 3, 1987

[54] ANNULAR GAP-TYPE BALL MILL

[75] Inventors: Peter Fabian, Bonn; Karl-Heinz Hoffmann, Rommerskirchen, both of Fed. Rep. of Germany

[73] Assignee: Reimbold & Strick GmbH & Co., Cologne, Fed. Rep. of Germany

[21] Appl. No.: 766,111

[22] Filed: Aug. 15, 1985

[30] Foreign Application Priority Data

Aug. 29, 1984 [DE] Fed. Rep. of Germany ..... 3431636

[51] Int. Cl.[4] ..... B02C 23/36

[52] U.S. Cl. ..... 241/172; 241/179

[58] Field of Search ..... 241/170, 171, 172, 175, 241/176, 179, 301

[56] References Cited

U.S. PATENT DOCUMENTS 4,225,092 9/1980 Matter et al. ..... 241/172 X

*Primary Examiner*—Timothy V. Eley

*Attorney, Agent, or Firm*—Spensley Horn Jubas & Lubitz

[57] ABSTRACT

The invention relates to an annular gap-type ball mill for continuously pulverizing in particular mineral hard materials comprising an upright grinding container closed by a cover, and housing a rotor whose cone-shaped outer surface limits with the cone-shaped inner surface of the grinding container a grinding gap communicating with a feed aperture and containing grinding pellets, the rotor having a top portion being adapted in its shape to the inner surface of the cover, and including within its range a discharge opening. The annular gap-type ball mill is characterized in that the top portion of the rotor is conical to limit with the cone-shaped cover an annular discharge gap whose lower end of maximum diameter ends in an annular chamber at the open upper end of the grinding gap. The grinding pellets are prevented from sinking down in the grinding gap of which 100% are utilized for the grinding operation so that the residence time required for the pulverization of the mineral hard materials is reduced.

18 Claims, 4 Drawing Figures

ANNULAR GAP-TYPE BALL MILL

BACKGROUND OF THE INVENTION

1. Field Of The Invention

The invention relates to an annular gap-type ball mill for pulverizing continuously in particular mineral hard substances comprising an upright grinding container closed by a cover and housing a rotor whose cone-shaped outer surface limits with the cone-shaped inner surface of the grinding container a grinding gap communicating with a feed aperture and containing grinding pellets, the rotor having a top portion being adapted in its shape to the surface of the cover and including with its range an outlet opening.

2. Description Of The Related Art

Mineral hard substances (Mohs' hardness > 5) such as corundum, circonium dioxide, alumina, silicon carbide and similar substances have been pulverized predominantly hitherto by iron balls in ball mills. Considerable residence times of the grinding material in the grinding chamber are involved therewith and all of the elements contacting the grinding material and the iron balls are exposed to a very strong wear. Further, the noise developing with the grinding operation is very disturbing. Moreover, as an additional disadvantage of said ball mills, the abrasion of the iron balls gets into the grinding material and requires chemical processes to be washed out by complicated, expensive means.

Annular gap-type ball mills of the above mentioned type (German laid-open print No. 28 48 479) are supposed to incorporate an improvement over conventional ones, but they are less suited for the size reduction of mineral hard substances, and they are only economic in view of the comminution of considerably softer substances such as chalk or the like. This is particularly due to the behaviour of the grinding balls or pellets in the grinding gap.

While the grinding pellets pumped together with the grinding stock through the feed opening from below or by a hollow shaft of the rotor from above into the grinding gap, first are moved up in the grinding gap due to the pressure of the feed pump by which the grinding stock suspension is pressed into the annular gap-type mill and by the rotational movement of the rotor, they sink down by gravity with decreasing pumping pressure so that a grinding operation may not take place in the upper part of the grinding gap. This may be avoided by increasing the feed pump pressure or the flow of the grinding material such as to keep the grinding pellets in the upper portion of the grinding gap. This involves the risk for the grinding pellets to be discharged together with the grinding stock thus causing a reduction of the grinding output. Experience has shown that with an average flow rate of the grinding material, only about the lower half of the grinding gap is fully utilized for the grinding operation, while the grinding output obtainable theoretically is only half-realized. Further, the high packing density of the grinding pellets in the lower part of the grinding gap causes a high wear of the surfaces of the rotor and the grinding container. The rotor may be even blocked, after all, upon a short rest period of the rotor and the feed pump. Said risk shall be excluded with an annular gap-type ball mill of the above mentioned design, in that the lower end of the rotor is provided with an impeller which, however, will intensify only another disadvantage of the annular gap-type ball mill to the effect that the grinding pellets, which do not sink down, are increasingly pumped with the grinding material to the discharge opening to thus be lost for the grinding operation. Moreover, the impeller is exposed to a great wear caused by the grinding pellets and the grinding material. Sometimes, screens are used to retain the grinding pellets in the grinding gap; however, they will inhibit the discharging of the grinding material to even stop such a discharge if they are clogged with grinding material and grinding pellets.

A uniform flow of grinding stock through the grinding chamber shall be ensured, with the mentioned annular gap-type ball mill, by a relatively high collecting chamber above the rotor which chamber is limited by the convexly curved end face of the rotor top portion and by the respectively convexly curved inner face of the cover of the grinding container, the collecting chamber communicating directly with the outlet opening. This collecting chamber may not contribute to the object of retaining grinding pellets in the grinding gap.

The more difficult starting of the rotor and the wear markings at rotor and grinding container due to the concentration of the grinding pellets at the lower end of an annular grinding gap inclined relative to the vertical line shall be avoided, according to another annular gap-type ball mill (DE-OS No. 30 22 809) in that rotor and grinding container are drawn apart axially, in case of demand, to enlarge the grinding gap. To this effect, complicated technical measures are required which result in a more expensive equipment. However, an increased effectivity of the grinding pellets in the grinding gap, i.e. utilization of the total grinding gap height for the grinding operation are achieved but to a slight extent only. In fact, the grinding pellets present in the grinding gap directed downwardly to the outside only follow the flow of the grinding stock instead of the counteracting it such as in the upwardly directed grinding gap so that the operation effected in this part of the grinding gap is only insufficient.

Another known annular gap-type ball mill (DE-OS No. 28 11 899) comprises a grinding stock container whose inner surface confines a grinding chamber into which dips a conical cam body, the inner surface of the grinding stock container and the displacement body being of an annular double-cone design. According to a probable further embodiment, the surfaces confronted with the grinding chamber may be rough or include elevations or recesses such as ribs, grooves, pins or the like.

However, this would cause an unbearable wear just with the grinding of hard materials. Neither the annular gap-type ball mill by itself nor said specific design lend themselves to pulverizing mineral hard substances.

In contradistinction thereto, the problem underlying the invention is to improve an annular gap-type ball mill of the foregoing type so that, by an increased effectivity of the grinding pellets in the grinding gap, an economic and technically perfect pulverization, even of mineral hard substances, is possible.

BRIEF SUMMARY OF THE INVENTION

The problem is solved in that the top portion of the rotor and the cover are shaped conically to limit an annular discharge gap whose lower end of maximum diameter ends in an annular chamber at an open upper end of maximum diameter of the grinding gap.

By means of an annular gap-type ball mill of such a design, one may economically pulverize optional mineral hard material such as corundum, circonium dioxide, alumina, silicon carbide etc., because the total height of the grinding gap is used for the active grinding operation of the grinding pellets, due to the fact that as a consequence of the conically designed rotor and its top portion, hydrodynamics and centrifugal force general a sucking force counteracting the gravity of the grinding pellets and preventing them from sinking down in the grinding gap of which 100% are utilized for the grinding operation because even in case of a slowly rotating rotor, the total gap height and width are penetrated by grinding pellets. Further, a discharging of the latter together with the grinding stock through the outlet opening and a resultant reduction of the grinding pellet amount or of the grinding effect are effectively inhibited.

The reason for it is that a predetermined surplus of grinding pellets is collected in the radial, annular chamber at the upper end of the grinding gap, i.e. within the range of the maximum rotor diameter to form there a floating barrier layer which while retaining the active grinding pellets in the grinding gap, does not act like a screen or the like to hinder the outflow of the pulverized material from the grinding gap towards the discharge opening. The grinding stock moved upwardly from the annular chamber through the narrow outlet gap between the rotor top portion and cover towards the discharge opening practically does not contain any grinding pellets thus exluding a subsequent separation of grinding pellets and grinding stock. Even if the width of the discharge gap is larger than the grinding pellet diameter, the grinding pellets are not conveyed upwardly through the discharge gap because they are retained in the radial annular chamber by gravity or centrifugal force. The residence times involved with the annular gap-type ball mill of the invention are longer because the used peripheral speeds of the rotor and the feed pump capacity may be lower. The grinding material between the grinding pellets thus moves very slowly in upward direction, the resultant grain spectrum of the grinding stock being narrow. It is possible for the annular gap-type ball mill of the invention to operate extremely satisfactorily with the use of grinding pellets of varying sizes, the coarse, heavier grinding pellets preferably grinding coarse portions of the stock in the lower part of the grinding gap while the finer, lighter grinding pellets preferably grind finer stock stock portions in the upper grinding gap part because centrifugal force and uplift of the lighter particles increase in upward direction. With a sufficiently long residence time of the material in the grinding gap, the hard material is shortly ground to powder of a desired fineness and discharged in a continuous flow. Corresponding to the higher filling in the grinding gap, the energy supplied to the rotor may be better utilized, and the operation of the annular gap-type ball mill is more economic.

According to an advantageous embodiment of the invention, the shape of the top portion and the inner surface of the cover are frustoconical.

It turned out to be an optimum measure that the grinding gap and the discharge gap are parallel-sided each, and that the grinding gap is broader than the discharge gap. However, to adapt the grinding gap and the discharge gap to the mineral hard material to be ground, it might be suitable to select other embodiments accordingly.

The grinding gap may be flared to the top, while the discharge gap is parallel-sided. Further, the grinding gap and also the discharge gap may be flared to the top, or the grinding gap may be flared to the top while the discharge gap is contracted in upward direction. In all of the cases, the existing annular chamber receives in connection with the oppositely directed cone of the rotor top portion the barrier layer of the grinding pellets to prevent the active grinding pellets from being discharged out of the grinding gap.

Advantageously, the annular chamber is situated within the region of the partition joint of grinding container and cover thus permitting, upon the removal of the cover, to take the grinding pellets out of the upper half of the chamber. The annular chamber is provided with one aperture at least for the introduction of the grinding pellets so that they are added from above and separately from the grinding stock introduced into the grinding gap. Thus, sinking of the grinding pellets to the bottom of the grinding container will be avoided additionally. Further, feeding of stock to be pulverized in the annular gap-type ball mill is facilitated because said stock need not be mixed any longer with grinding pellets to be only subsequently introduced in common with them, such as practiced hitherto.

It also turned out to be favorable that the annular chamber is substantially parallel-sided and convexly rounded at its peripheral end face. Due to such a shape, the chamber is adapted to the spherical form of the grinding pellets thus reducing their wear to a minimum.

The ratio of the height of the top portion to the overall height of rotor and top portion is 0.2 to 0.5:1. In other words, the top portion is shorter than the rotor. Suitably, the conical outer surface of the rotors extends at an angle of 40° to 85°, preferably of 60° to 80°, in particular of 70° to 80° to the vertical line. The cone inclination of the rotor is adapted to the kind of hard material to be comminuted, and the cone inclination of the top portion correspondingly results from the ratio of its height to the total height.

The inner surface of the grinding container and of the cover as well as the outer surface of the rotor and of its top portion are of a finely rough condition. This means that they should not be either very smooth or very rough. Such finely rough condition may be obtained by a suitable coating of the surfaces, for inst. by means of polyurethane as a protective layer against corrosion and wear. To avoid thermal accumulations, the rotor may be ventilated inside. Further, the grinding container and the cover may be enclosed by a cooling fluid jacket.

BRIEF DESCRIPTION OF THE DRAWINGS

Embodiments of the invention are schematically illustrated in the enclosed drawings.

DESCRIPTION OF THE PREFERRED EMBODIMENT

Figure 1:
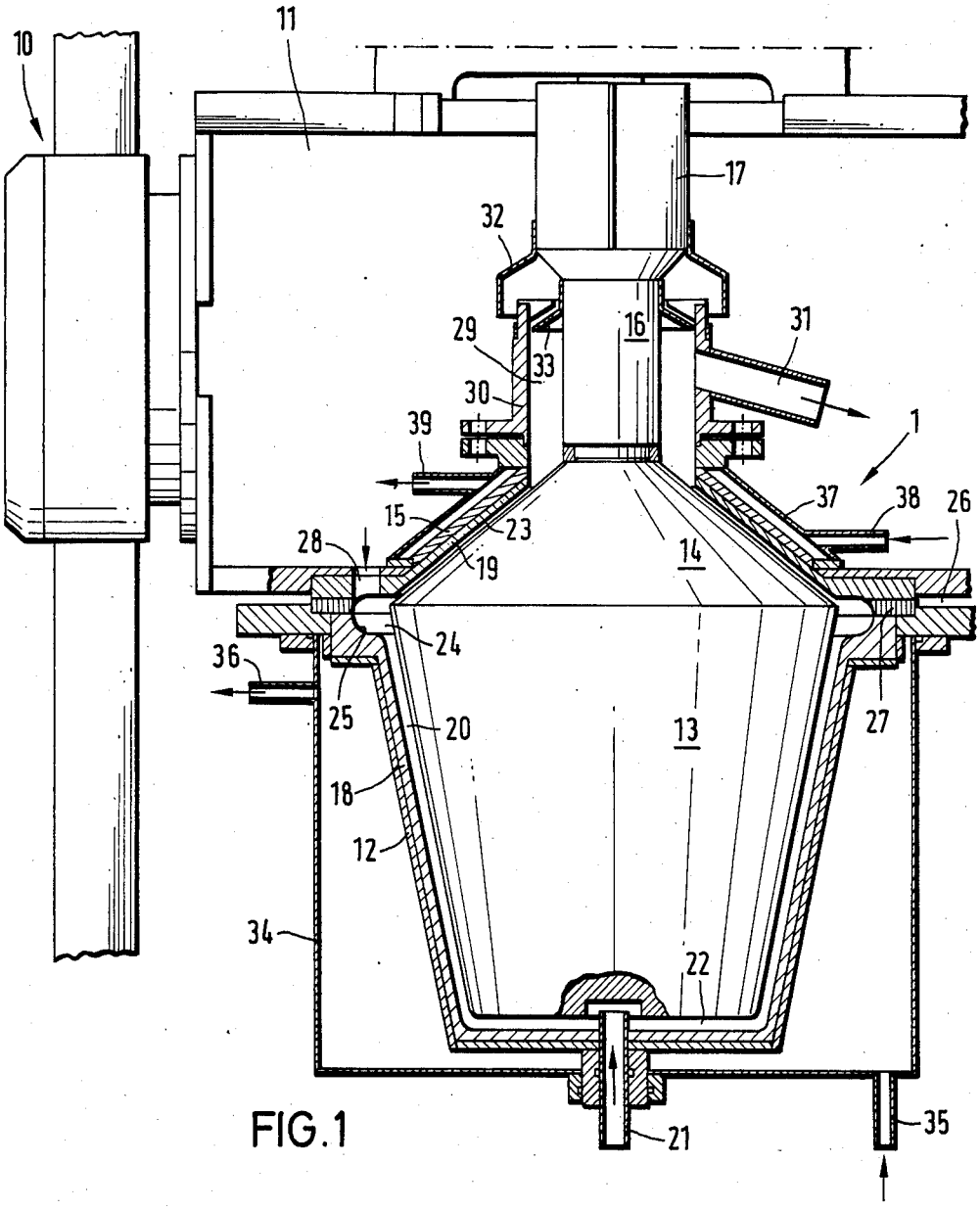
FIG. 1 is a longitudinal section of an annular gap-type ball mill.

An annular gap-type ball mill 1 suspended at an optional support 10 on an arm 11 substantially consists of a stationary frusto-conically shaped grinding container 12 and of a frusto-conically shaped rotor 13 whose broad upper end is flush-composed with the broad lower end of a frusto-conical top portion 14 of a height inferior to that of rotor 13. A cover 15 detachably mounted on the grinding container 12 and adapted to the conical inclination of the top portion 14 is fitted to close the latter in slightly spaced relationship. The upper end of the top portion 14 engages a vertical shaft 16 supporting rotor 13 and top portion 14 to be free-floating in the grinding container 12 and transmitting the drive of the motor 17 to the top portion 14 and to the rotor 13. The total inner surface of the grinding container 12 and of the cover 15 is provided with a wear- and corrosion-resisting lining 18,19 which may consist of a finely roughened surface, e.g. of polyurethane, the outer face of the rotor 13 and of the top portion 14 being provided with a corresponding finely roughened surface not drafted for the sake of clarity.

Between the outer face of rotor 13 and the inner surface of the grinding container 12, a parallel-walled annular grinding gap 20 communicates through a horizontal interspace 22 between the plane bottoms of the grinding container 12 and the rotor 13 with a lower central feed aperture 21 for the grinding stock.

A discharge gap 23 also being parallel-sided is situated between the top portion 14 and the cover 15 or its lining 19. The width of said gap extending over the total height of the top portion 14 is inferior to the width of the grinding gap 20. The lower end of the downwardly divergent discharge gap 23 and the upper end of the upwardly divergent grinding gap 20 extending into an annular chamber 24 provided substantially in the linings 18 and 19. Its upper and lower plane walls are in parallel relationship. Its outer end face 25 extends in a convex curvature. The chamber 24 being situated on the partition joint between cover 15 and grinding container 12, it may be opened by the removal of cover 15. A spacer 27 inserted into the partition joint 26 may be exchanged against a spacer of another thickness to change the width of the grinding gap 20 and to thus lift or lower to a higher or lesser extent the grinding container 12 relative to the rotor 13. The chamber 24 is accessible through an opening 28 in the cover flange. Through said opening 28, grinding pellets may be introduced into the grinding gap 20 if the rotor 13 is rotating with the top portion 14 an upon the introduction through the feed aperture 21 of mineral hard substances from below into the grinding gap.

Shaft 16 traverses a discharge chamber 29 in a piece 30 flanged to the cover 15. The wall of said connecting piece 30 contains a discharge opening 31 for the finely reduced material which is pressed from the discharge gap 23 into the discharge chamber 29. The upper end of the connecting piece 30 is provided with guide plates 32, 33 forming ventilation slots.

The grinding container is enclosed by a housing 34 including a cooling water inlet 35 and a cooling water outlet 36.

The cover 15 is also encompassed by a housing 37 provided with a cooling water inlet 38 and a cooling water outlet 39.

If the annular gap-type ball mill 1 is operated, the motor 17 first rotates rotor 13 with the top portion 14. Subsequently, grinding material (dross) is introduced through the feed aperture 21 into the grinding gap 20 and thereafter, grinding pellets are added through the opening 28 which are of the same material as the stock to be reduced in size so as to ensure that abrasion of grinding pellets does not contaminate the grinding and to obtain substances of high priority. The maximum peripheral speed being achieved at the upper end of the grinding gap 20 due to the conical shape of the rotor 13 and its top portion 14, a resultant upwardly directed sucking effect prevents the grinding pellets from sinking down in the grinding gap 20. A surplus of grinding pellets is collected in the chamber 24 thus bringing about a floating barrier layer avoiding a discharging of the grinding pellets through the grinding gap 20. Due to the grinding pellets present in the grinding gap 20, the latter is filled over its total height so that 100% of the gap are used in favor of the grinding operation, the grinding stock being exposed to a maximum grinding attack during its residence time in the gap 20. Grinding pellets which, by wear, have been reduced such as to fit into the discharge gap 23 are recycled into the chamber 24 by centrifugal force so that the powder discharged from the discharge opening 31 does not contain grinding pellets and is available in its final desired condition without needing any aftertreatment such as washing or screening.

The grinding pellets being reliably hindered in the grinding gap from being sedimented, any risk concerning starting difficulties or blocking is excluded for the rotor. Thus, the wear of the elements is correspondingly low. Low energy inputs permit high grinding outputs for mineral hard substances, the duration of the residence time of the material in the grinding gap being adjustable by a corresponding selection of the peripheral speed and of the width of the grinding gap. The degree of comminution may be influenced by the size of the grinding pellets which, if necessary, may optionally vary thus achieving a stepwise pulverization because coarse grinding pellets in the lower portion of the annular gap-type ball mill preferably are responsible for grinding coarse pieces, while the finer grinding pellets in the upper part preferably pulverize the finer pieces.

Figure 2:
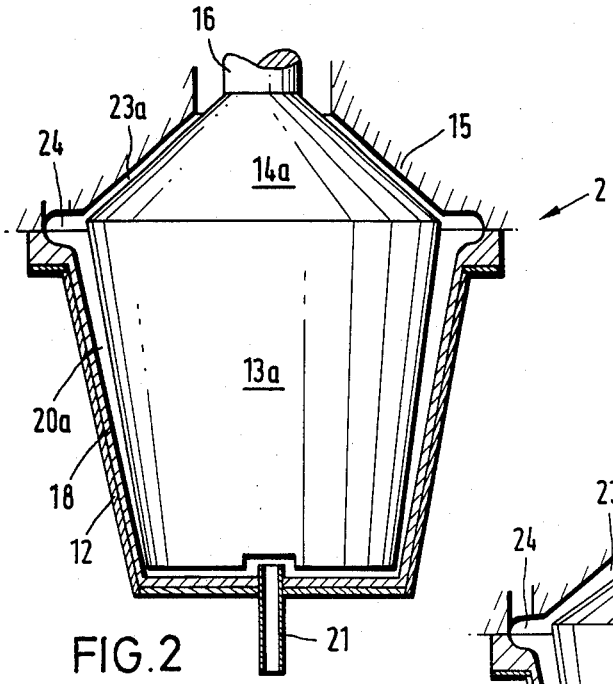
FIGS. 2, 3 and 4 show longitudinal sections of annular gap-type ball mills comprising different grinding gap and discharge gap designs.
Figure 3:
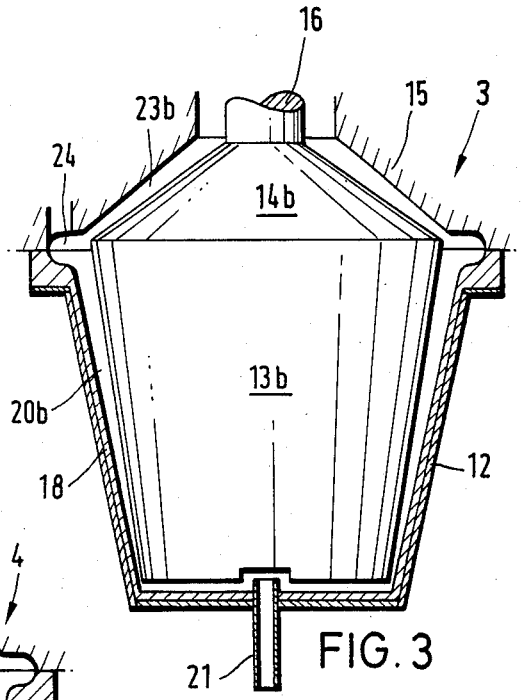
Figure 4:
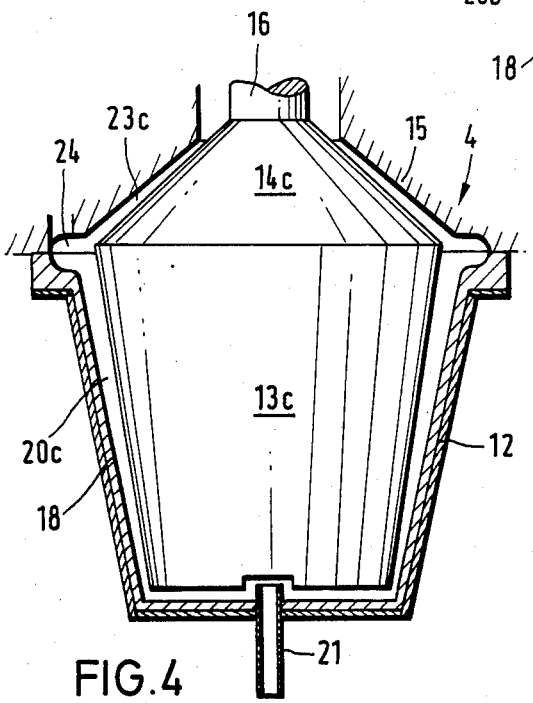

The embodiments of FIGS. 2, 3 and 4 illustrate annular gap-type ball mills 2,3,4 which, as to their construction, substantially correspond to the design of FIG. 1. Only possible modifications of the cross sections of the grinding gap and of the discharge gap are drafted schematically which, subject to the type of mineral hard material to be pulverized might be advantageous. In all of the cases, the annular radial chamber 24 is provided to receive the grinding pellet barrier layer, said chamber being present at the transition between the grinding gap **20*a*, 20*b*, 20*c* to the discharge gap 23*a*, 23*b*, 23*c*. Said transition is substantially identical to the equator line betwen rotor 13*a*, 13*b*, 13*c* and top portion 14*a*, 14*b*, 14*c***.

In the Example of FIG. 2, the grinding gap **20*a* is flared to the top, while the discharge gap 23*a*** is parallel-sided.

According to FIG. 3, the grinding gap **20*b* is larger at the top than at the bottom and the discharge gap 23*b*** is also enlarged upwardly.

FIG. 4 shows another embodiment according to which the grinding gap **20*c* is flared to the top, just like grinding gaps 20*a* and 20*b*, while the discharge gap 23*c* is contracted upwardly to end with a broader lower end in the chamber 24**.

The angle of inclination of the rotor **13, 13*a*, 13*b*, 13*c*** relative to the vertical line is advantageously 70° to 80°, to obtain the best grinding results.

What is claimed is:

1. Annular gap-type ball mill for continuously pulverizing hard mineral substances, comprising:

an upright grinding container closed by a cover;

a rotor housed in said grinding container and minimum diameter end and an upper, maximum diameter end, the inner surface of the grinding container also being cone-shaped and having a lower, minimum diameter end and an upper, maximum diameter end such that the inner surface and outer surface define a grinding gap communicating with a feed aperture and containing grinding pellets;

the rotor having a top portion whose shape conforms to that of the cover and which communicates with a discharge opening;

the top portion of said rotor and said cover being cone-shaped and having a lower, maximum diameter end and an upper, minimum diameter end such that the top portion and cover define an annular discharge gap.

2. The annular gap-type ball mill according to claim 1 wherein the shape of the top portion and of the inner surface of the cover is frusto-conical.

3. The annular gap-type ball mill according to claim 1 wherein the grinding gap and the discharge gap are each parallel-sided, the grinding gap being broader than the discharge gap.

4. The annular gap-type ball mill according to claim 1 wherein the grinding gap is flared toward the top and the discharge gap is parallel-sided.

5. The annular gap-type ball mill according to claim 1 wherein the grinding gap and the discharge gap are flared toward the top.

6. The annular gap-type ball mill according to claim 1 wherein the grinding gap is flared toward the top and the discharge gap narrows toward the top.

7. The annular gap-type ball mill according to claim 1, wherein the anular chamber is situated around the periphery of a partition joint located between the grinding container and the cover.

8. The annular gap-type ball mill according to claim 1, wherein the annular chamber contains at least one opening for receiving the grinding pellets.

9. The annular gap-type ball mill according to claim 7, wherein the annular chamber is substantially parallel-sided and its peripheral end face is rounded outwardly.

10. The annular gap-type ball mill according to claim 1, wherein the ratio of the height of the top portion to the overall height of rotor and top portion is between 0.2:1 to 0.5:1.

11. The annular gap-type ball mill according to claim 1, wherein the cone-shaped outer surface of the rotor extends between an angle of 40° to 85° relative to vertical.

12. The annular gap-type ball mill according to claim 1, wherein the inner surface of the grinding container and of the cover and the outer surface of the rotor and of its top portion are provided with fine roughened surfaces.

13. The annular gap-type ball mill according to claim 1, wherein the upper end of the discharge gap ends in a discharge chamber to which the discharge opening is connected.

14. The annular gap-type ball mill according to claim 1, wherein a cooling liquid jacket encloses the grinding container and the cover.

15. The annular gap-type ball mill of claim 1, wherein the cone-shaped outer surface of the rotor extends between an angle of 70° to 80° relative to vertical.

16. An annular gap-type ball mill for continuously pulverizing hard mineral substances, comprising:

an outer member having side walls and a bottom defining an inside surface and an outside surface and being closed by a cover having an inside surface and an outside surface;

an inner member housed within the outer member and having an outer surface with a top portion housed within the cover, the inner member being rotatable relative to the outer member;

means for imparting relative rotation between the outer member and inner member;

the inner member having a bottom portion having a cone-shaped outer surface and the inside surface of the outer member side walls also being cone-shaped such that the outer surface of the inner member and the inside surface of the outer member side walls define a grinding gap communicating with a feed aperture passing through the bottom of the outer member and containing grinding pellets;

the cover inside surface and inner member top portion being cone-shaped and defining an annular discharge gap such that the discharge gap terminates at the grinding gap in an annular chamber, the cover further having a discharge opening.

17. The annular gap-type ball mill according to claim 16, wherein the grinding gap between the inner member and outer member is non-uniform.

18. The annular gap-type ball mill of claim 1, wherein the lower, maximum diameter end of the annular discharge gap terminates in an annular chamber communicating with the upper, maximum diameter end of the grinding gap.

* * * * *

UNITED STATES PATENT AND TRADEMARK OFFICE

CERTIFICATE OF CORRECTION

PATENT NO. : 4,703,896

DATED : Nov. 3, 1987

INVENTOR(S) : Peter Fabian; Karl-Heinz Hoffmann

It is certified that error appears in the above-identified patent and that said Letters Patent is hereby corrected as shown below:

Column 6, line 67, after "and" insert --having a cone-shaped bottom portion having an outer surface having a lower,--

Signed and Sealed this

Twenty-first Day of March, 1989

*Attest:*

*Attesting Officer*

DONALD J. QUIGG

*Commissioner of Patents and Trademarks*